US005918872A

United States Patent [19]

Kato et al.

[11] Patent Number: 5,918,872

[45] Date of Patent: Jul. 6, 1999

[54] SHEET BINDING APPARATUS WITH SHEET SET SHIFTING MEANS AND IMAGE FORMING APPARATUS WITH THE SAME

[75] Inventors: Katsuhito Kato, Kawasaki; Yoshifumi Takehara, Yokohama, both of Japan

[73] Assignee: Canon Kabushiki Kaisha, Tokyo, Japan

[21] Appl. No.: 08/971,685

[22] Filed: Nov. 17, 1997

Related U.S. Application Data

[63] Continuation of application No. 08/634,890, Apr. 22, 1996, abandoned, which is a continuation of application No. 08/365,424, Dec. 28, 1994, abandoned.

[30] Foreign Application Priority Data

Dec. 28, 1993 [JP] Japan ..... 5-334363

[51] Int. Cl.[6] ..... B65H 39/11; G03G 15/00

[52] U.S. Cl. ..... 270/58.12; 270/58.16; 270/58.17; 270/58.27; 355/324

[58] Field of Search ..... 270/58.12, 58.16, 270/58.17, 58.27; 271/213; 355/323, 324; 414/788.3, 789.9, 790.3

[56] References Cited

U.S. PATENT DOCUMENTS

| | | | |
|---|---|---|---|
| 3,774,906 | 11/1973 | Fagan et al. | 270/58 X |
| 4,208,122 | 6/1980 | Iwato et al. | 355/323 |
| 4,318,539 | 3/1982 | Lamos | 270/58 |
| 4,376,529 | 3/1983 | George et al. | 270/53 |
| 4,382,592 | 5/1983 | Harding et al. | 270/53 |
| 5,044,625 | 9/1991 | Reid | 270/58.16 X |
| 5,090,688 | 2/1992 | Sasaki . | |
| 5,282,611 | 2/1994 | Ueda et al. . | |
| 5,344,131 | 9/1994 | Lawrence | 270/58.17 |
| 5,384,634 | 1/1995 | Takehara et al. | 355/324 |
| 5,443,248 | 8/1995 | Hayashi et al. | 270/53 |
| 5,447,297 | 9/1995 | Murata et al. | 270/53 |
| 5,449,167 | 9/1995 | Takehara et al. | 270/58 X |

FOREIGN PATENT DOCUMENTS

| | | | |
|---|---|---|---|
| 57-156957 | 9/1982 | Japan | 271/213 |
| 58-183566 | 10/1983 | Japan . | |
| 64-43460 | 2/1989 | Japan . | |
| 3-293259 | 12/1991 | Japan | 270/58 |

*Primary Examiner*—Hoang Nguyen
*Attorney, Agent, or Firm*—Fitzpatrick, Cella, Harper & Scinto

[57] ABSTRACT

A sheet binding apparatus includes at least one bin tray for accommodating sheets; at least one binding device for binding a set of sheets in the bin; a first sheet moving device for moving the sheet sets in the bin tray; and a second sheet moving device for moving the sheets sets in the bin tray in a direction crossing with the direction of movement by the first sheet moving device; wherein the bin is provided with a sheet stopper, to which the trailing edge of the sheet is abutted, and at least one cut-away portion for accommodating the binding device when the binding device operates, and wherein an upstream corner of the sheet set moved by the second moving device is opposed to a region other than the cut-away portion.

33 Claims, 10 Drawing Sheets

SHEET BINDING APPARATUS WITH SHEET SET SHIFTING MEANS AND IMAGE FORMING APPARATUS WITH THE SAME

This application is a continuation of application Ser. No. 08/634,890, filed Apr. 22, 1996, now abandoned, which is a continuation of application Ser. No. 08/365,424, filed Dec. 28, 1994, now abandoned.

FIELD OF THE INVENTION AND RELATED ART

The present invention relates to a sheet binding apparatus with sheet set shifting means. More specifically, it relates to a sheet binding apparatus characterized in that after sheets of recording medium such as copy paper, on which an image has been formed, are discharged from the main assembly of an image forming apparatus such as a copying machine, printer, or laser beam printer, the sheet binding apparatus binds the sheets, using stapling means or the like, and then shifts the bound sheet set.

As for the binding means, there are stapling means, clip-binding means, stapleless binding means, or the like. In the case of the stapleless binding means, the sheets are slightly damaged to entangle the sheets by the damaged portions.

In a conventional stapling type sorter capable of stapling at two or more points, a sheet stopper J1b, on which the tailing edge of the sheet rests, is pivotable as shown in FIG. 13. When the sheets are clinched by a stapler J2, the sheet set is first gripped by a movable gripper J3; then, the sheet stopper J1b is pivoted so as to be aligned substantially in the plane of the bin J1a: next, the sheet set is shifted to a clinching position of the stapler J2; and the sheets are clinched.

In recent years, however, multiple deposition type sorters have been introduced, in which two or more sets of sheet are deposited per bin tray, and the deposited sheet sets are separated from each other by being shifted as they are deposited in the bin. When a conventional binding structure is used with this new type of sorter so that the sheet sets can be bound at two points, the sheet sets, which are not gripped by the gripper, slide off the bin tray as the sheet stopper J1b is pivoted. Therefore, it is necessary to grip the sheet sets with the gripper. However, in the case of the sorter which deposits multiple sheet sets in a single bin tray, the gripper is required to grip multiple sheet sets, which are differently situated from each other, when one of the sheet sets is to be clinched. This creates a problem; the structure becomes extremely complicated.

SUMMARY OF THE INVENTION

The present invention was made in view of the problem of the conventional apparatus described above, and its primary object is to provide a sheet binding apparatus which affords multiple sheet set deposition per bin tray.

According to an aspect of the present invention, there is provided a sheet binding apparatus comprises: at least one bin tray for accommodating sheets; at least one binding means for binding a set of sheets in the bin; first sheet moving means for moving the sheet sets in the bin tray; and second sheet moving means for moving the sheets sets in the bin tray in a direction crossing with the direction of movement by the first sheet moving means; wherein the bin is provided with a sheet stopper, to which the trailing edge of the sheet is abutted, and at least one cut-away portion for accommodating the binding means when the binding means operates, and wherein an upstream corner of the sheet set moved by the second moving means is opposed to a region other than the cut-away portion.

The sheet binding apparatus according to the present invention has the above structure, wherein the notch for accommodating the binding means advance is formed by cutting out a portion of the stopper of the bin tray, and the sheet sets are shifted so that after the shifting, the trailing corner of the sheet sets remains within a bin tray range where the stopper has not been cut out. Therefore, even after the sheet sets are shifted and the shifting force is removed, the trailing end of the sheet set is held by the uncut stopper portion of the bin tray. As a result, the sheet set does not slide off the bin tray. In addition, after being bound by the binding means, the bound sheet sets can be shifted; therefore, it is possible to deposit multiple sheet sets per bin tray.

According to another aspect of the present invention, one end of the sheet stopper, which comes in contact with the trailing edge of the sheet is tapered; therefore, the sheet set can be smoothly shifted, which improves reliability in the multiple sheet set deposition.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Below, the present invention will be described with reference to an illustrated preferred embodiment example.

Figure 6:
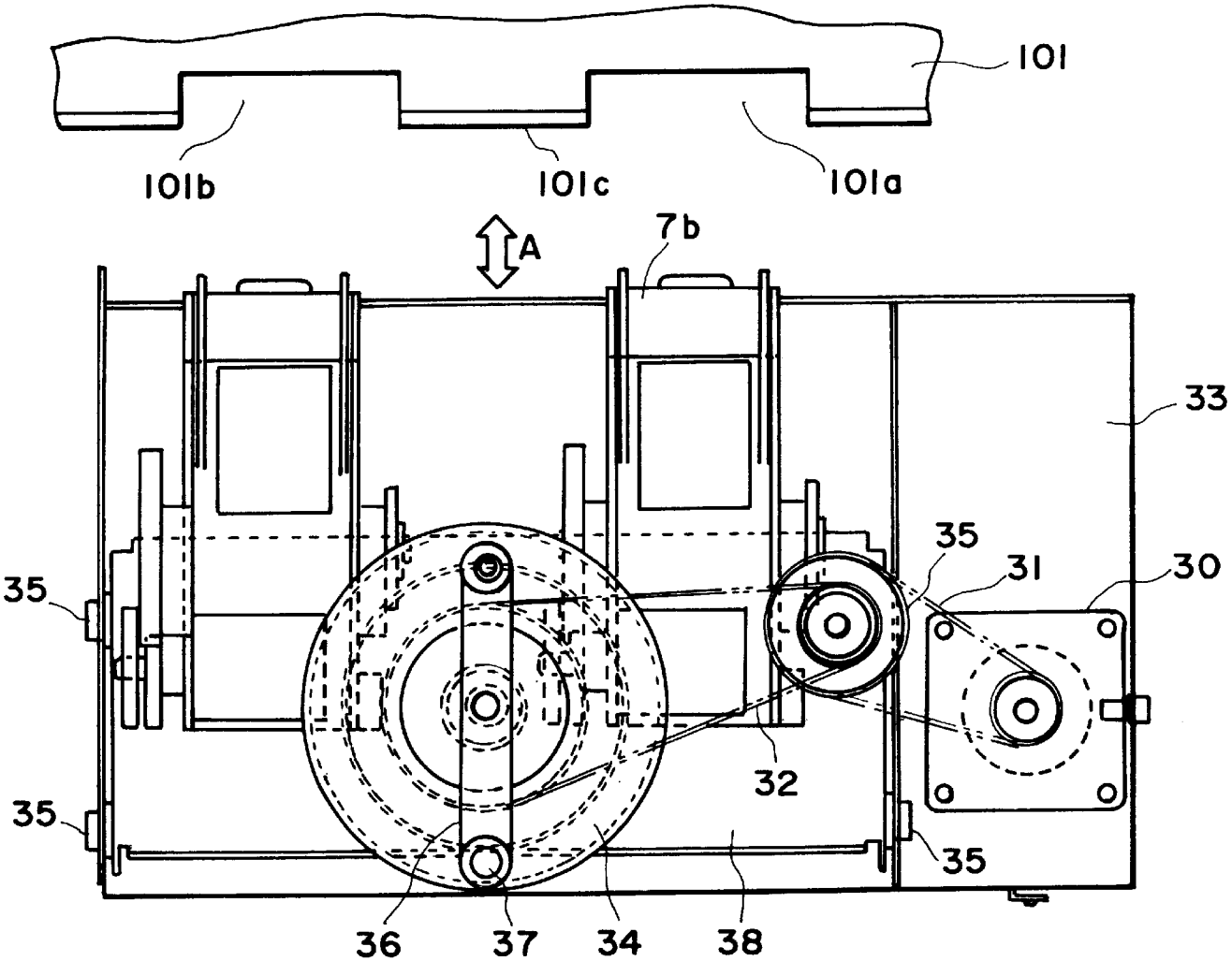
FIG. 6 is an enlarged plan view of the binding portion of the sheet binding apparatus.

First, referring to FIG. 6, the structure and operation of the stapler will be described.

A frame 33 is affixed to the main frame of the sorter A movable table 38 is provided with four rollers 35, which are fitted in unillustrated guiding grooves provided on the frame 33, enabling the movable table 38 to move smoothly in the direction of an arrow A. A pulse motor 30 is provided on the frame 33, and its driving force is transmitted through the belts 31 and 32 to rotate a link 34 provided also on the frame 33. The link 34 is provided with an arm 36 and a pin 37, wherein the pin 37 engages with the movable table 38. Therefore, as the link 34 rotates once, the movable table 38 reciprocates once in the A direction. A stapler 7 is mounted on the movable table 38. The stroke of the link 34 is equal to the distance between the retracted position of the stapler and the clinching position of the stapler; therefore, as the link 34 is rotated once, the stapler 7 is enabled to carry out a single cycle of operational sequences including clinching and retracting. Thus, in this embodiment example, the sheets in each bin tray can be stapled simultaneously at two points by staplers 7*a* and 7*b*. Further, in this embodiment example, a bin 101, into which the sheet is discharged, and the bin, in which the sheets are stapled, are the same bin, wherein when the stapler 7 clinches the sheets, and a pass guide 4, which will be described later, is caused to retract by an unillustrated mechanism.

It should be noted that the sheet set may be bound at two points correspondent to notches 101*a* and 101*b*, by moving a single stapling means between the notches 101*a* and 101*b*, parallel to the rear end 101*c* of the bin tray.

Referring to FIGS. 7–11, the operational sequence of at two point binding-multiple deposition mode will be described. In this case, two or more sheet sets are deposited per bin tray, and each sheet set is bound at two points.

Figure 7:
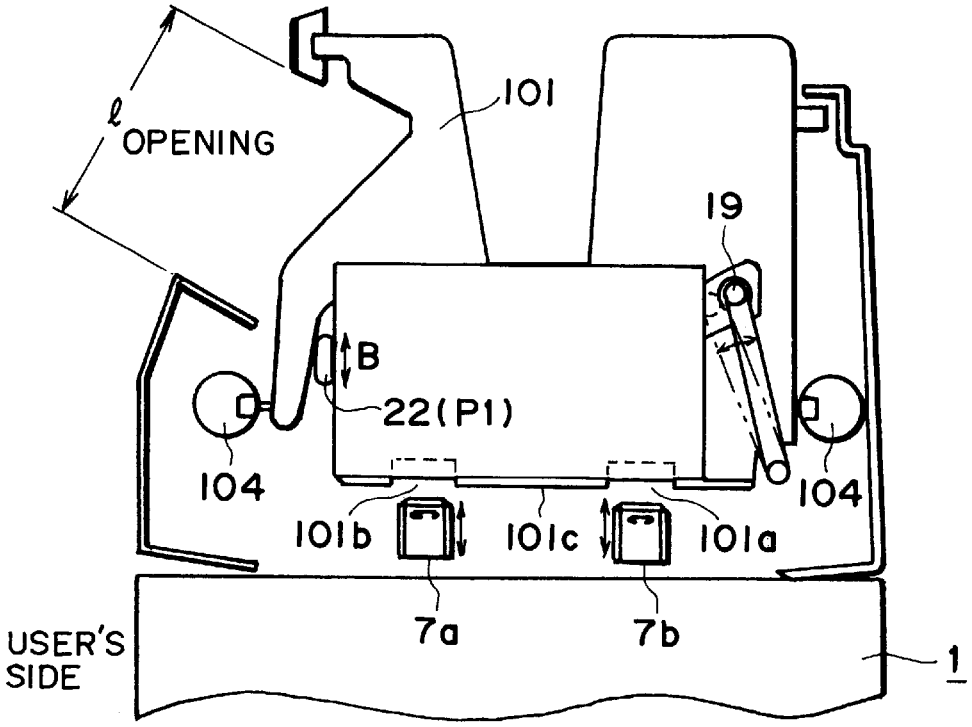
FIG. 7 is a plan view of the sheet binding apparatus according to the present invention, and describes its operation.
Figure 8:
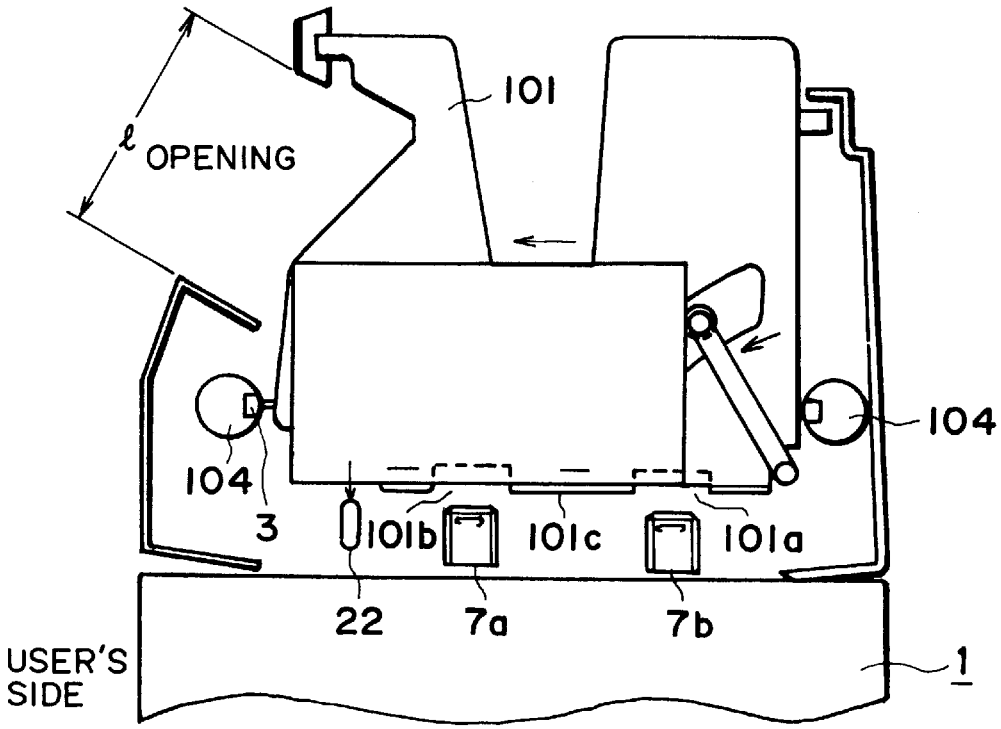
FIG. 8 is a plan view of the sheet binding apparatus according to the present invention, and describes a sequel operation to FIG. 7.

A reference 22 designates a reference rod, which can be smoothly moved in the direction of an arrow B as it is driven, through a belt 24, by a pulse motor 25 (FIG. 3) provided on the bin frame. A reference rod position illustrated in FIG. 7 is a home position P1, where the reference rod 22 serves as a referential wall when the sheets are aligned. The sheets discharged into the bin 101 are sequentially pushed by an aligning rod 19, becoming aligned as they come in contact with the reference rod 22. After a given number of sheets, which are equivalent to a first sheet set, is discharged in each bin tray, the staplers 7*a* and 7*b* follow the aforementioned operational sequence to bind sequentially the sheet sets.

After the completion of the stapling operation, the reference rod 22 is retracted to a position out of overlapping with the trailing edge of the sheet sets, and then, the aligning rod 19 pushes the sheet set so that the reference rod 19 side end of the sheet set reaches to a position overlapping with the trailing edge.

Figure 9:
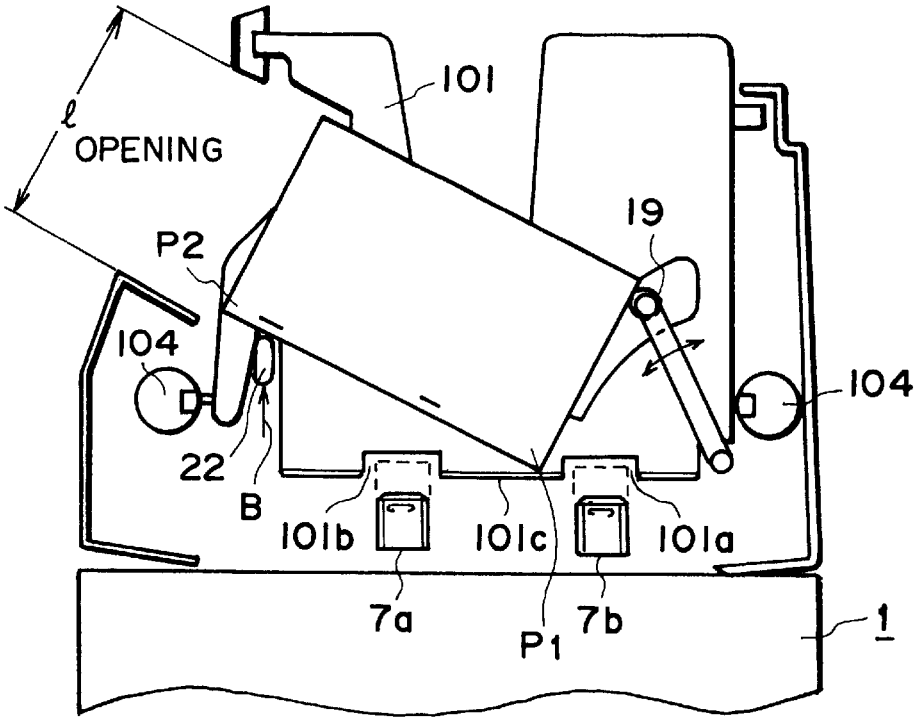
FIG. 9 is a plan view of the sheet binding apparatus according to the present invention, and describes a sequel operation to FIG. 8.

Next, the reference rod 22 pushes the sheet set up till the one end P2 of the trailing edge of the sheet reaches an opening 1 (FIG. 9). At this time, the sheet set does not slide into the notch 101*a* or 101*b* since the notches 101*a* and 101*b* are cut out in such a manner that a sheet stopper portion 101*c* having a long enough length is left.

Figure 10:
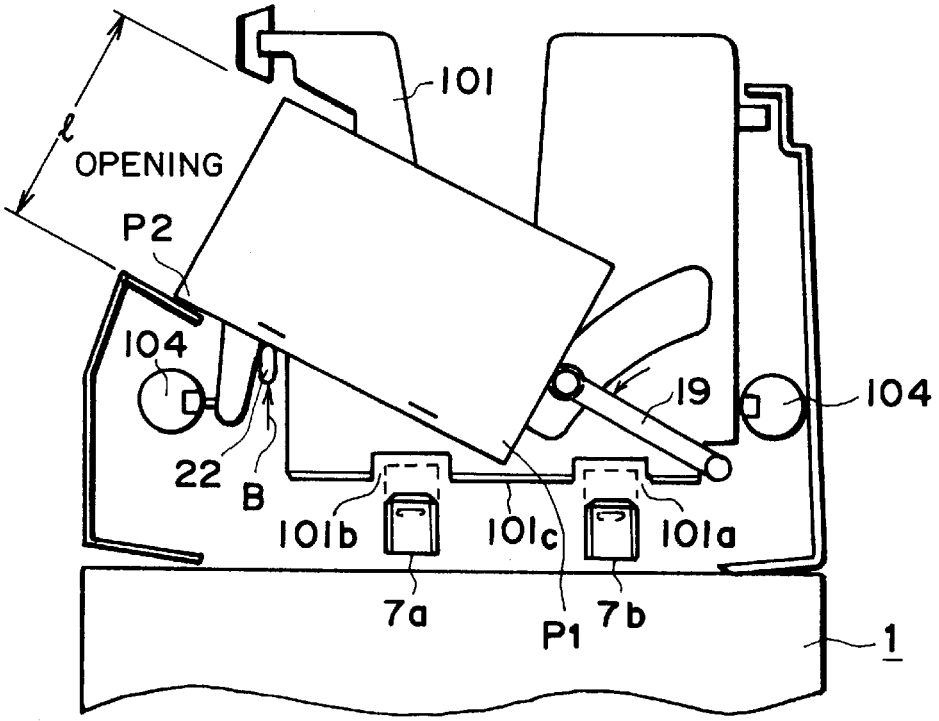
FIG. 10 is a plan view of the sheet binding apparatus according to the present invention, and describes a sequel operation to FIG. 9.
Figure 11:
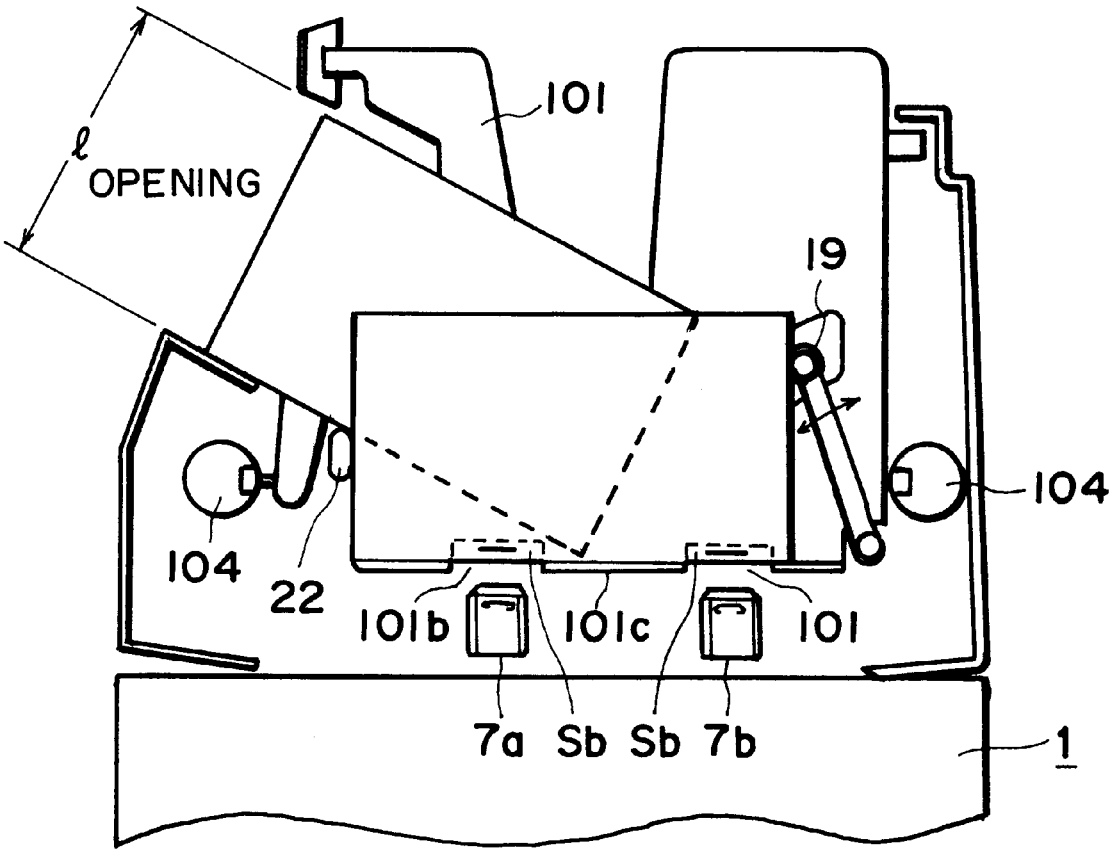
FIG. 11 is a plan view of the sheet binding apparatus according to the present invention, and describes a sequel operation to FIG. 10.

Next, the aligning rod 19 rotates in the counterclockwise direction as shown in FIG. 10, whereby the sheet set is pushed toward the opening 1 to a position where the sheet set can be easily taken out of the apparatus. Also at this time, the sheet set does not slide down since the sheet stopper portion 101*c* is given sufficient length to remain in contact with the other end P1 of the trailing edge of the sheet.

The above operational sequence is repeated to accumulate two or more sheet sets bound at two points, per bin tray. Also at this time, the bin trays are shifted, but since the trailing end of the sheet is held by the sheet stopper portion 101*c*, the sheet does not fall off the bin tray as it does in the case of the apparatus according to the prior art.

Figure 12:
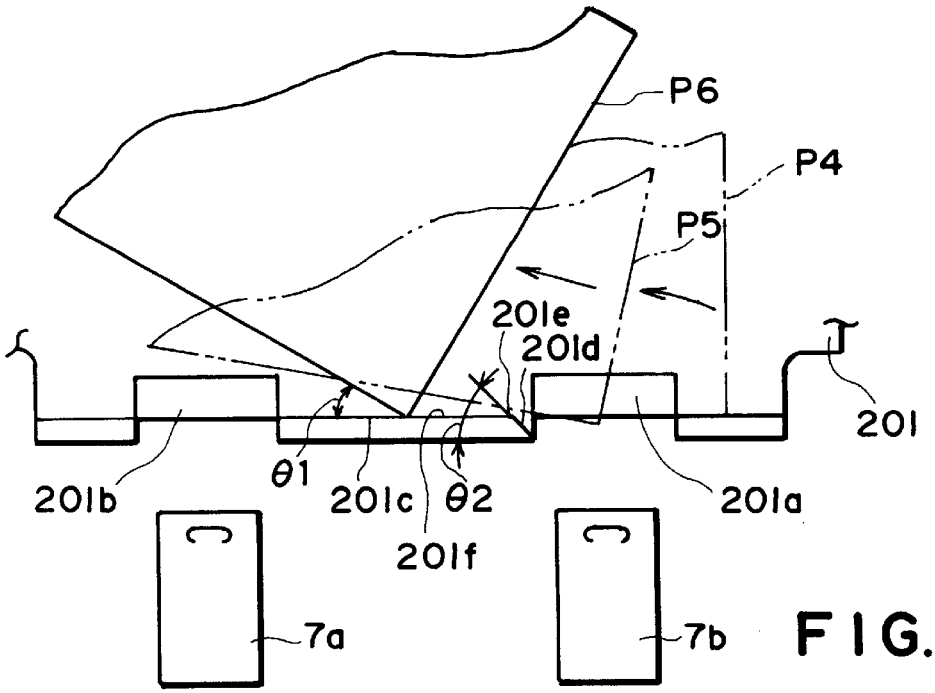
FIG. 12 is an enlarged plan view of a different embodiment example of the present invention.
Figure 13:
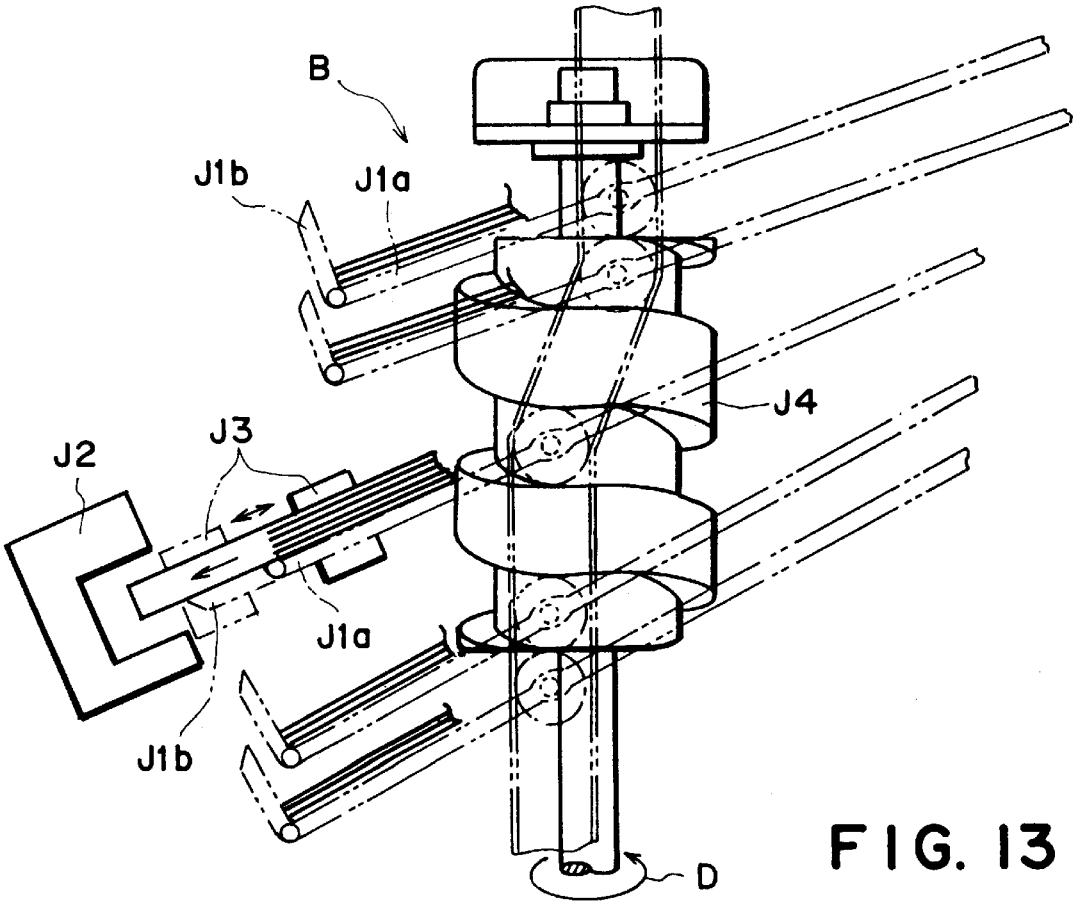
FIG. 13 Is a schematic sectional view of a sheet binding apparatus according to the prior art.

Referring to FIG. 12, the second embodiment example will be described.

This second embodiment example provides the same effects as the first embodiment example. In addition, according to this embodiment, the sheet set can be more smoothly shifted by the reference rod 22.

A reference 201*d* designates a slanted surface of the sheet stopper 201*c*. A corner portion 201*e* is rounded, connecting smoothly a horizontal surface 201*f* and the slanted surface 201*d*. An angle θ2 formed by the slanted surface 201*d* and horizontal surface 201*f* is rendered larger than the maximum angle θ1 at which the sheet set is slanted. Therefore, while the sheet set is pushed up by the reference rod 22, the trailing edge of the sheet contacts the rounded portion 201*e*, and does not come in contact with the slanted surface 201*d*, regardless of the sheet set orientation (P4, P5 and P6). Therefore, the sheet set can be smoothly shifted without such problems as hanging up or being scratched.

Next, the basic structure of the image forming apparatus, from which the present invention was derived, will be described.

Figure 1:
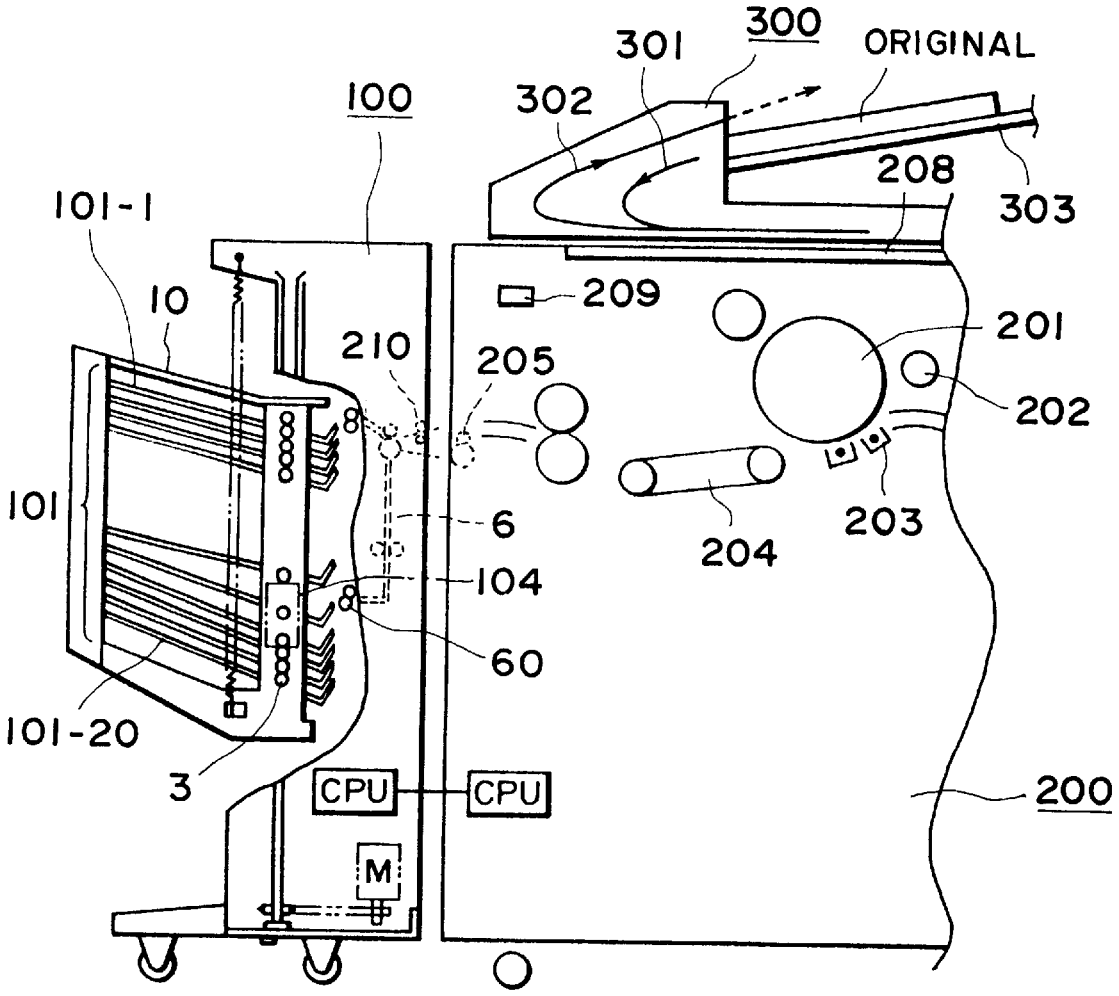
FIG. 1 is a schematic sectional view of an image forming apparatus comprising a sheet binding apparatus according to the present invention.

FIG. 1 is a general view of an image forming apparatus comprising a sheet binding apparatus according to the present invention. There are provided on the top surface of the main assembly of an image forming apparatus 200, on automatic original feeding apparatus 300 which automatically circulates the originals, and on the downstream side, a sorting apparatus (sheet binding apparatus) 100 comprising twenty bin trays b (b1, b2 . . . b19, and b20).

The image forming apparatus main assembly 200 employs a known electrophotographic system, which will not be detailed here. Basically, it optically forms on a photosensitive drum 201 an image reflecting an original positioned on a platen glass 208; develops the image with a developing apparatus 202 disposed adjacent to the photosensitive drum 201; transfers the developed image onto a sheet S with a transfer electrode 203; and permanently fixes it with a fixing apparatus 205.

The sorting apparatus 100 is of a so-called moving bin type, In which vertically arranged bin trays are moved up or down through the rotation of a spiral cam 104, at a ratio of one bin interval per one rotation.

Figure 2:
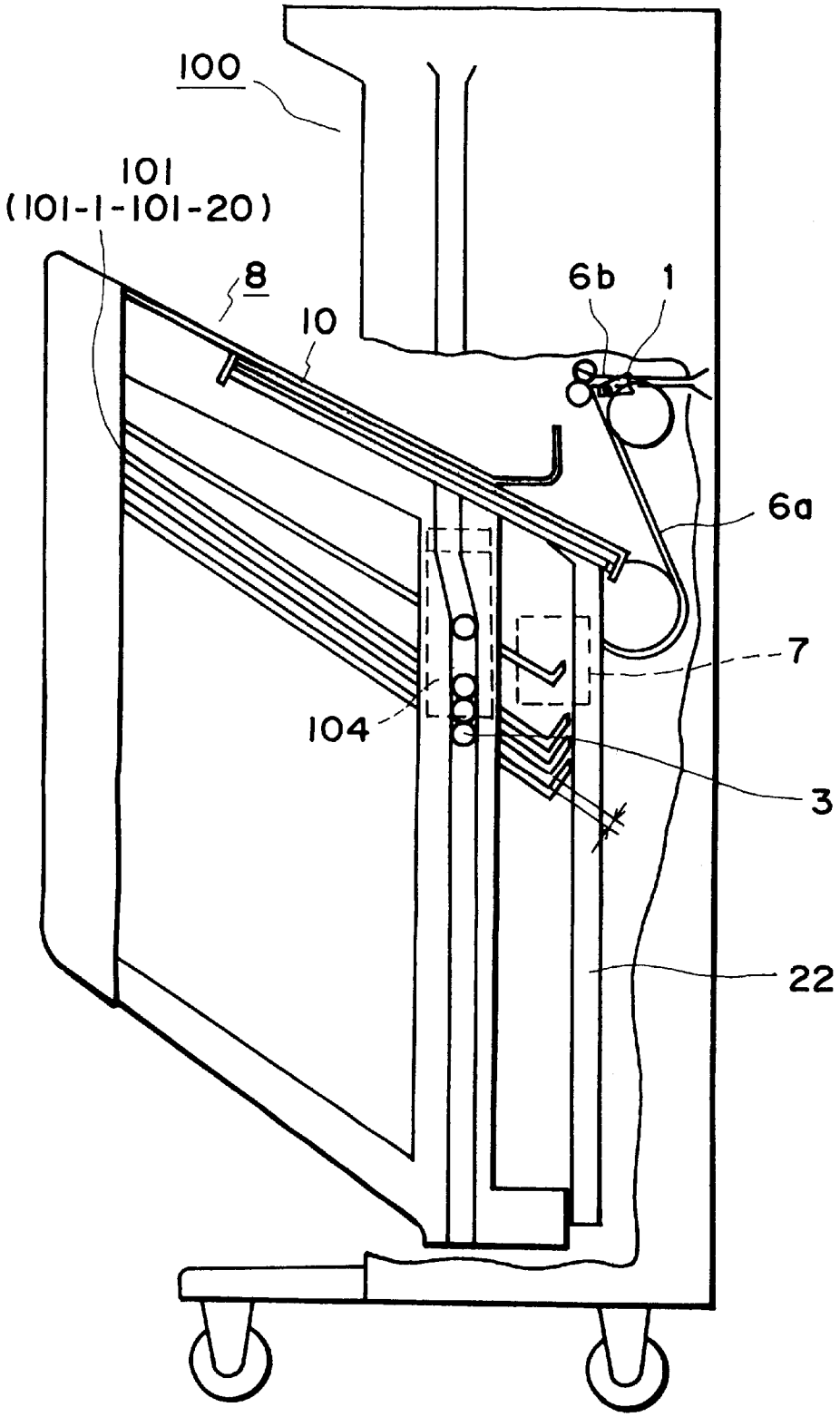
FIG. 2 is an enlarged schematic sectional view of the sheet binding apparatus illustrated in FIG. 1.

The sheet, on which an image has been formed by the image forming apparatus main assembly 200, is delivered to the sorting apparatus 100 by way of a discharge roller pair 205. In the sorting apparatus, the sheet is directed either toward a sort path 6*a* or a non-sort path 6*b* by a flapper 1 (FIG. 2). In a non-sort mode during which the sheet is not sorted, all the sheets S are passed through the on-sort path 6*b* and discharged into a non-sort tray 10 (flapper 1 is oriented as illustrated by a chain line). In a sort mode during which the sheet is sorted, it is passed through the sort path 6*a* (flapper 1 is oriented as illustrated by a solid line) and is discharged by the discharge roller 650 so as to be stored one for one into each of the bin trays being synchronously moved up or down in the vertical direction. The detailed description of the means for moving vertically the bin trays is disclosed in a Japanese Laid-Open Patent Application No. 183566/1983, and 43460/1990.

Figure 3:
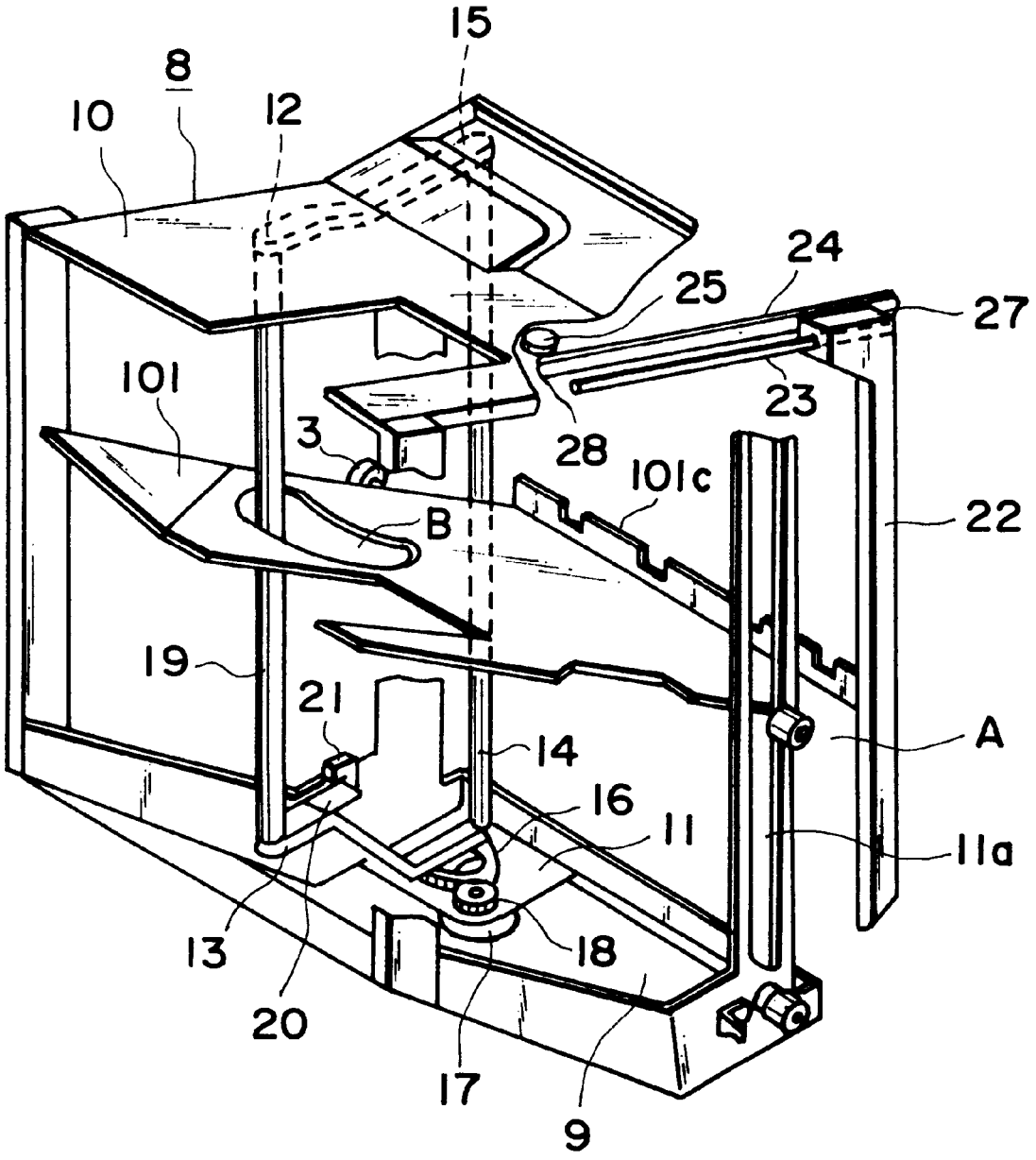
FIG. 3 is a perspective view of the sheet binding apparatus illustrated in FIG. 1.

Referring to FIG. 3, a bin unit 8 holding the bin tray b is composed of a non-sort tray 10, a base frame 9 and a pair of lateral guide plates 11, wherein the lateral guide plates 11 bridge between the non-sort tray 10 and the base frame 9, on the correspondent sides, giving the bin unit a box shape. The bin tray 101 is tilted in such a manner that its downstream side relative to the sheet discharging direction becomes lower. It has a pair of pins 3 (trunnion), each of which is fixed on the corresponding side of the bin tray 101 and is inserted in a hole 11*a* of the lateral guide plate 11.

There are attached on the bottom rear side of the base frame 9, a supporting plate 11, and on this supporting plate 11, an axial rod 14 is mounted, being fixed to an upper arm 12 by the top end, and to a bottom arm 13 by the bottom end The axial rod 14 is rotatively supported between a rotational axis (unillustrated) provided on the supporting plate 11, and a rotation axis 15 provided on the bottom surface of the non-sort tray 10.

Further, there is disposed on the supporting plate 11, a sector gear 16, to which the bottom arm 13 is fixed. This sector gear 16 is rotatable about the axis provided on the supporting plate 11. Further, there is disposed on the bottom side of the supporting plat 11, a pulse motor 17, of which output shaft is fixed to a gear 18. The gear 18 meshes with the sector gear 16.

Between the tips of the top and bottom arms 13 and 12, an aligning rod 19 is bridged in a manner to penetrate through the opening B provided in each bin tray 101. This aligning rod 19 is oscillated by the rotational oscillation of the sector gear 16. Further, a photo-interrupter plate 20 is provided on the bottom arm 13. It oscillates together with the bottom arm 13, turning on or off a home position sensor 21 provided also on the rear side of the base frame 9. When the sheet is discharged, the aligning rod 19 is oscillated such a manner a to jog the sheet against the reference wall, so that the sheet is accumulated while being aligned.

The bin tray 101 is provided with a notch A, which is located on the side opposite to where the aligning rod 19 is, and through this notch A, a reference rod 22 is put through. The reference rod 22 is mounted on a guide rail 23 supported right below the non-sort tray 10, and is fixed to a belt 24, which is stretched, in parallel to the guide rail 23, between a pulley 26 of a pulse motor 25 fixed below the non-sort tray 10, and an idler pulley 27. The reference rod 22 is movable by the forward or backward rotation of the pulse motor 25, between a position off the bin tray 101 path (behind the stopper), where the reference rod 22 retreats, and an active position where the reference rod 22 is when the sheets are aligned or pushed out.

The guide rail 23 is attached in such a manner that the moving direction of the reference rod 22 becomes substantially parallel to the tilt angle of the bin tray 101 to improve the efficiency with which the sheet in the bin tray 101 is pushed by the reference rod 22 (FIGS. 2 and 3).

Further, the image forming apparatus main assembly 200 and sorting apparatus illustrated in FIG. 1 comprise control circuits CPU, which control their operations and communications.

Next, referring to flow charts in FIG. 5, the operations of the sorting apparatus will be described.

(Step 1); an operator places a set of original D on an original table 303 of the automatic original feeding apparatus 300 illustrated in FIG. 1. Then, the operation of the image forming apparatus is started (start key is pressed) after optional information such as the number n of the copy sets to be made, stapling mode (stapling or not), is entered through the control panel (unillustrated) of the image forming apparatus.

(Step 2); the control circuit of the image forming apparatus main assembly 200 is informed of the sheet count N1 of the originals D. This number N1 may be directly entered by the operator when he sheet count N1 is known in advance, or the originals D is idled through the automatic original feeding apparatus 300 so that the sheets of the originals D are counted.

(Step 3); the control circuit determines the number N2 of the sheet sets to be deposited per bin on the basis of the selected sheet set number n. For example, when n=0–20, N2=1; when n=21–40, N2=2; when n=41–60, n=3; and so on, since the apparatus in this embodiment example comprises 20 bin trays.

Then, the maximum number N3 of the sheets depositable per bin tray (it is experimentally obtained in advance, and is inputted to the control circuit), and it is determined whether or not the following formula is satisfied:

$$N1 \times N2 < N3$$

(Step 4); when "No" is the answer obtained in Step 3, it means that the number of sheets to be discharged per bin tray exceeds the storage capacity per bin tray. Therefore, the operator is informed of the problem by one of available means (warning sound, display message, or the like).

(Step 5); when "Yes" is the answer obtained in Step 3, the reference rod 22 is moved to the position P1, and the aligning rod 19 is moved to a standby position corresponding to the size of the sheet to be discharged, as shown in FIG. 7.

(Steps 6 and 7); after the above preparation, the sheets discharged from the image forming apparatus main assembly 200 are sorted.

At this time, when the number n is set to be higher than the bin tray count (20), the sorting operation is initially carried out for twenty sets. On the other hand, when the copy set count n is set to be smaller than the bin tray count, the sorting operation is carried out for n sets. The automatic original feeding apparatus separates a bundle of the originals D from the bottom; in other words, the original sheets are fed starting from the last original sheet. The separated sheet of the original is delivered onto a platen glass of the image forming apparatus main assembly 200 through a path 301 and stopped there (FIG. 1). Then, an unillustrated optical system functions to form an image. The sheet of recording mediuni on which the image has been transferred and fixed is passed through the sort path 6*a*, and is discharged into the first bin tray 101-1 (which has been standing by facing the discharge roller). The sheet discharged into the bin tray 101-1 slides down, by its own weight, on the surface of the bin tray tilted down toward the stopper 101*c*.

Then, the aligning rod 19 is moved by the pulse motor 17, pushing the sheet as it comes in contact with the sheet edge. After being moved a predetermined distance, it is stopped at a first sheet position, and then, returned to the standby position to be prepared for the next sheet discharge. When the aligning rod 19 is at the first sheet position, one edge of the sheet is in contact with the aligning rod 19 and the other is in contact with the reference rod 22. The pulse motor 17 rotates in response to pulse signals correspondent to the sheet size.

The above is the description of the sheet flow to the bin tray. Next, the spiral cam 104 is rotated to move the next bin tray to align it With the discharge roller par, and the transfer sheet on which the last page of the original has been copied is aligned, with its lateral edge being in contact with the reference rod 22 and the rear edge being in contact with the stopper 101*c*.

After the image of the last page of the original is completely transferred, the original on the platen glass 208 is discharged, through a path 302, on top of the topmost sheet of the original sheet set D placed on the original table 303, wherein a separator lever (unillustrated) is interposed between the copied and yet-to-be copied originals to separate them.

The above operation is repeated the number of times correspondent to the number of sheets in the set of originals, whereby a predetermined number of copy sets are stored, being aligned, in the bin trays. At this time, the set of ordinals having been fed one cycle through the automatic original feeding apparatus is back in the normal order, that is, the first page is on top.

(Step 8); it is determined whether or not the mode set in Step 1 is "stapling mode". when it is "stapling mode", a Step 9 is taken, and when it is "non-stapling mode", the Step 11 is taken.

Figure 5:
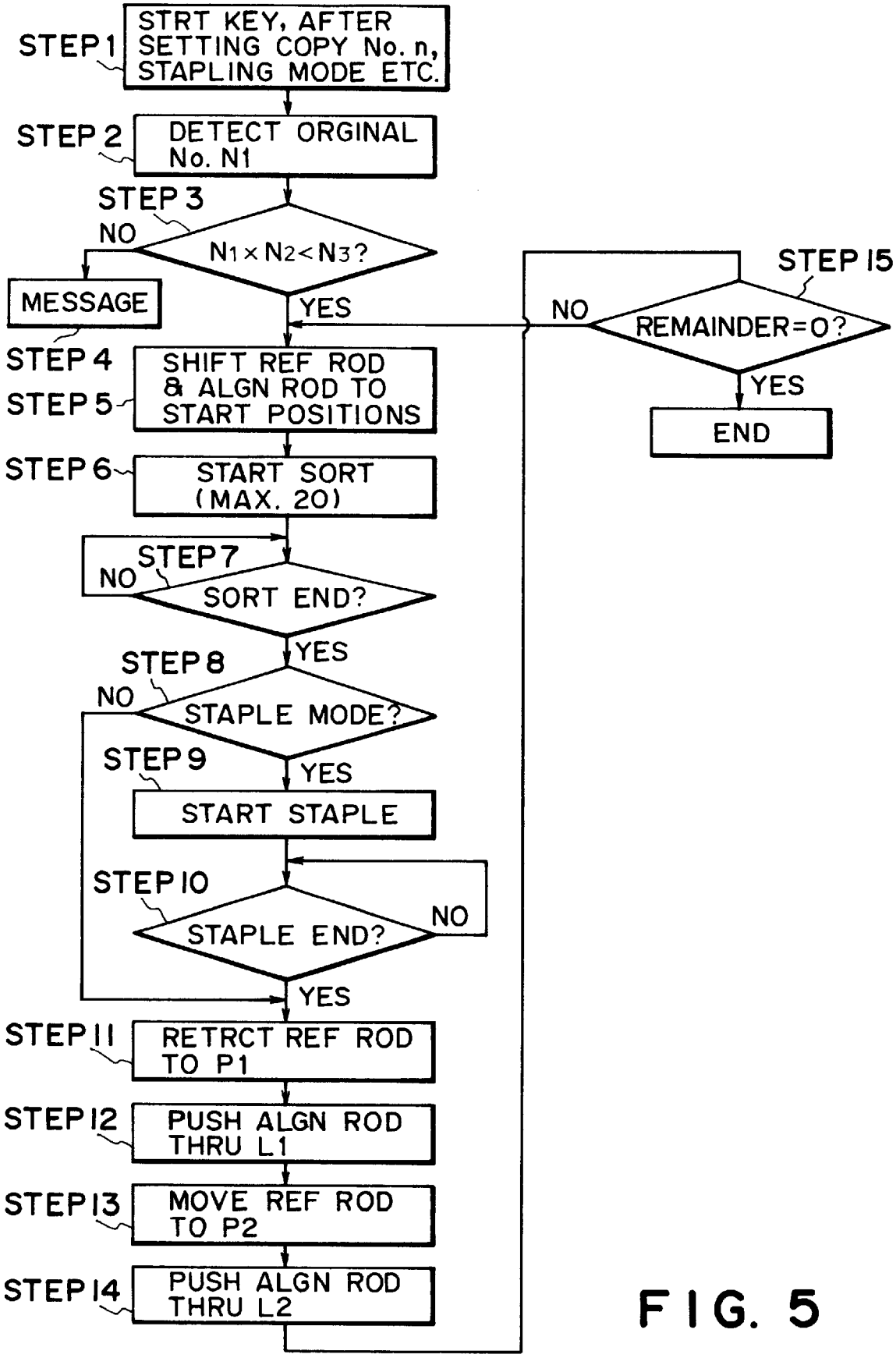
FIG. 5 is an operational flow chart for the sheet binding apparatus illustrated in FIG. 1.

(Steps 9 and 10); as the stapler 7 having been standing by at the home position receives a start signal from the control circuit CPU, it moves to the stapling position, as illustrated in FIG. 5, and places a staple at the rear corner of the sheet. At this time, the sheets are held from both sides by the reference rod 22 and aligning rod 19, respectively, being prevented from becoming misaligned. After stapling, the stapler 7*a* and 7*b* is returned to the home position. Then, the spiral cam 104 is rotated once to move the bin trays by the single bin interval, so that the sheets in the next tray can be stapled.

The above operation is repeated to staple all the sheet sets.

(Step 11); the reference rod 22 having been in contact with the lateral edge of the sheet at the aligning reference position is moved by the pulse motor 25. The locus which the reference rod 22 follows at this time is such that the reference rod 22 moves away (by a distance k) from the sheet edge; therefore, the sheet set is not disturbed by this movement of the reference rod 22.

(Step 12); next, as the pulse motor 17 is driven, the aligning rod 19 is moved a predetermined distance from the aligning position. As the aligning rod 19 moves, the sheet is pressed on the lateral edge, and therefore, is pushed out toward the front side of the apparatus, sliding along the stopper 101*c*, (second sheet position).

Figure 4:
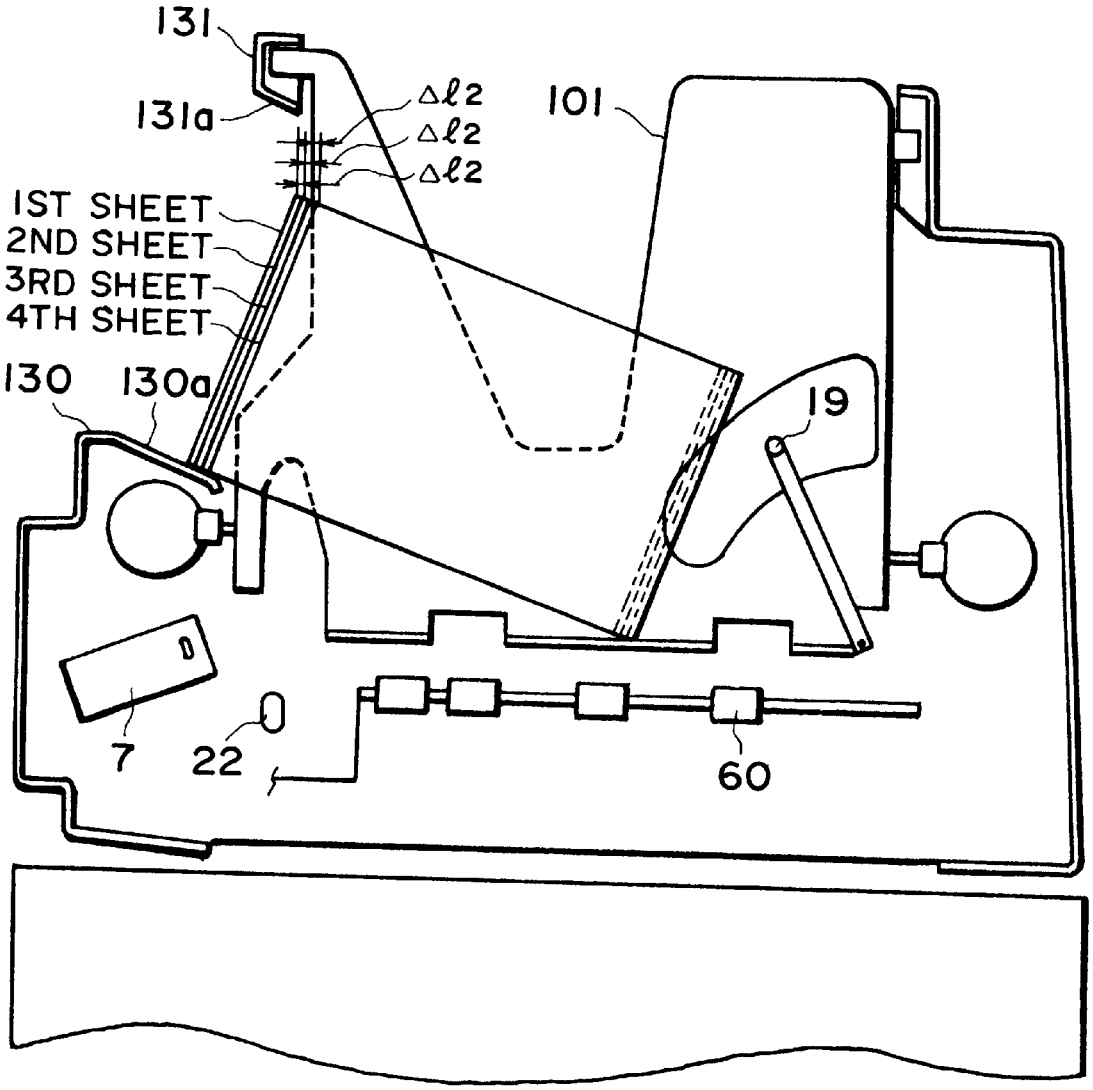
FIG. 4 is a plan view of the sheet binding apparatus illustrated in FIG. 1.

(Step 13); the reference rod 22, which has retreated in Step 11, returns to the position P1 while pushing the rear edge of the sheet. As a result, the sheet, which rests on the reference rod 22 and stopper 101*c* by the rear edge, and is held by the aligning rod 19 by the lateral edge, is skewed in the bin tray as illustrated in FIG. 4 (third sheet position).

(Step 14); then, the aligning rod 19 is moved in the arrow direction by a predetermined distance. As a result, the lateral edge of the sheet is clearly pushed out of the apparatus (fourth sheet position) by the above movement of the aligning rod 19, since a sufficient space for the sheet to pass is provided between the slanted surfaces 30*a* and 31*a* of front covers 30 and 31, respectively, of the sorting apparatus 100. Since the aligning rod 19 and reference rod 22 are put through all the bin trays, the sheets in all the bin trays are pushed toward the front of the apparatus, with no interference from the spiral cam 104, stapler 7, cover or the like, by the above movement.

(Step 15); at this point, it n sets of sheet (n being the number selected in Step 1) have been sorted, the operation of the apparatus ends without a further action, whereas, if more sheet sets need to be sorted, Steps 5–14 are repeated.

Below, a case in which two or more sheet sets are deposited per single bin tray will be described.

A sheet, which belongs to the second set for the bin tray, is discharged on top of the first sheet set which has been obliquely situated at the fourth sheet position in the bin tray, and is aligned there in the same manner as the sheet in the first sheet sets. After sorting operation, when it is determined that the "stapling model" has been set, the second sheet set is stapled at a point within a non-overlapping area Sb between the first sheet set situated at the fourth sheet position and the second sheet set situated at the first sheet position, so that only the sheets belonging to the second sheet sets saturated at the first sheet position are stapled.

Subsequently, the reference rod 22 is moved to the position P1 as it has been in Step 11. At this time, the rear corner of the first sheet set for the bin is rested on the end portion (slanted surface) 30*a* of the cover 30, and therefore, its attitude is not disturbed. Next, the second sheet set is also pushed out to the fourth sheet position through the Steps 12–14. This sequence remains the same for the third sheet set and thereafter which are going to be deposited in the same bin, whereby two or more sheet sets are evenly stacked, each set being separable from adjacent ones by the presence of the staples.

On the other hand, when it is determined that the "non-stapling" mode has been set, the aligning rod 19 is also moved a predetermined distance, wherein in Step 14, the distance the aligning rod 19 is moved for the first sheet set is preset at L2, whereas in this case, the distance is set at (L2−Δ12) for the second sheet set, (L2−2×Δ12) for the third sheet set, and so on, whereby two or more sheet sets ar stacked per bin tray in a staggered manner by an offset of Δ12 (FIG. 4).

The staggering method with the offset of Δ12 may be also employed to separate assertively the sheet sets when the "stapling" mode is set. The employment of this method will be bring forth no adverse effect.

Further, when this sorting apparatus is used just to stagger the two or more sheet sets per bin tray, it is not always necessary for the sheet sets situated at the fourth sheet position to be partially projected from the apparatus. Instead, the sheet sets may be staggered using the skewed and straight positions.

While the invention has been described with reference to the structures disclosed herein, it is not confined to the details set forth and this application is intended to cover such modifications or changes as may come within the purposes of the improvements or the scope of the following claims.

What is claimed is:

1. A sheet binding apparatus comprises:

at least one bin tray for accommodating sheets;

at least one binding means for binding a set of sheets in said bin tray;

first sheet moving means for moving the sheet sets in said bin tray; and second sheet moving means for moving the sheets set in said bin tray in a direction crossing with a direction of movement by said first sheet moving means;

wherein said bin tray is provided with a sheet stopper, to which an edge of the sheet is abutted, and at least one cut-away portion for permitting said binding means to access the sheets when said binding means operates; and wherein an upstream corner of the sheet set moved by said second moving means is opposed to a region other than the cut-away portion.

2. A sheet binding apparatus according to claim 1, wherein said first sheet moving means pushes the sheet set to rotate the sheet set, and said second sheet moving means pushes the sheet set, which has been inclined by the rotation, in the inclined direction.

3. A sheet binding apparatus according to claim 2, wherein said first sheet moving means moves the sheet set after the sheet set is bound.

4. A sheet binding apparatus according to claim 1, wherein said binding means includes two stapling means, and the cut-away portion is provided for each of the stapling means.

5. A sheet binding apparatus according to claim 1, wherein an edge of the sheet stopper formed by the cut-away portion at an upstream position in a width direction is tapered at an angle i2 which is larger than an angle i1 formed between the sheet set moved by said second moving means and the sheet stopper.

6. A sheet binding apparatus according to claim 1, wherein an edge of the sheet stopper formed by the cut-away portion at an upstream position in a width direction is rounded.

7. An image forming apparatus comprising:

image forming means;

discharging means for discharging a sheet on which an image has been formed; and a sheet binding apparatus comprising:

at least one bin tray for accommodating sheets;

at least one binding means for binding a set of sheets in said bin tray;

first sheet moving means for moving the sheet sets in said bin tray; and second sheet moving means for moving the sheet sets in said bin tray in a direction crossing with the direction of movement by said first sheet moving means;

wherein said bin is provided with a sheet stopper, to which an edge of the sheet is abutted, and at least one cut-away portion for permitting said binding means to access the sheets when said binding means operates; and wherein an upstream corner of the sheet set moved by said second moving means is opposed to a region other than the cut-away portion.

8. An image forming apparatus according to claim 7, wherein said first sheet moving means pushes the sheet set to rotate the sheet set, and said second sheet moving means pushes the sheet set, which has been inclined by the rotation, in the inclined direction.

9. An image forming apparatus according to claim 8, wherein said said first sheet moving means moves the sheet set after the sheet set is bound.

10. An image apparatus, comprising:

image forming means for forming images on sheets;

at least one bin tray for accommodating the sheets on which the images have been formed;

at least one binding means for binding a set of sheets in said bin tray;

first sheet moving means for moving the sheet set in said bin tray; and second sheet moving means for moving the sheet sets in said bin tray in a direction crossing with a direction of movement by said first sheet moving means;

wherein said bin is provided with a sheet stopper, to which an edge of the sheet is abutted, and permitting said binding means to access the sheets when said binding means operates; and wherein an upstream corner of the sheet set moved by said second moving means is opposed to a region other than the cut-away portion.

11. An image forming apparatus according to claim 10, wherein said first sheet moving means pushes the sheet set to rotate the sheet set, and said second sheet moving means pushes the sheet set, which has been inclined by the rotation, in the inclined direction.

12. A sheet binding apparatus according to claim 11, wherein said binding apparatus further comprises binding means driving means, and shifts said first sheet moving means after the sheet set is bound.

13. A sheet binding apparatus according to claim 10, wherein said binding means includes two stapling means, and the cut-away portion is provided for each of the stapling means.

14. A sheet binding apparatus according to claim 10, wherein an edge of the sheet stopper formed by the cut-away portion at an upstream position in a width direction is tapered at an angle i2 which is larger than an angle i1 formed between the sheet set moved by said second moving and the sheet stopper.

15. A sheet binding apparatus according to claim 10, wherein an edge of the sheet stopper formed by the cut-away portion at an upstream position in a width direction is rounded.

16. An apparatus according to claim 2, wherein said at least one bin tray comprises a plurality of bin trays arranged substantially vertically, and wherein said first sheet moving means and said second sheet moving means are extended substantially vertically and simultaneously move the sheet sets in said plurality of bin trays.

17. An apparatus according to claim 8, wherein said at least one bin tray comprises a plurality of bin trays arranged substantially vertically, and wherein said first sheet moving means and said second sheet moving means are extended substantially vertically and simultaneously move the sheet sets in said plurality of bin trays.

18. A sheet binding apparatus comprising:

a plurality of bin trays arranged and spaced substantially vertically;

binding means for binding a set of sheets on each of said bin trays at a respective binding position;

sheet set inclining means for simultaneously inclining bound sheet sets on said bin trays away from the binding positions;

wherein after operation of said sheet set inclining means, subsequent sheets are sorted on said bin trays and bound by said binding means.

19. An apparatus according to claim 18, wherein said inclining means comprises a rod which penetrates said bin trays to push one end of each of the sheet sets to rotate the sheet sets.

20. A sheet binding apparatus comprising:

at least one bin tray for accommodating sheets;

binding means for binding a set of sheets on said bin tray at least at two binding positions;

sheet set inclining means for inclining a bound sheet set on said bin tray away from the binding positions;

wherein after operation of said sheet set inclining means, subsequent sheets are stacked on said bin tray and bound by said binding means.

21. An apparatus according to claim 20, wherein said binding means comprises a binding device for each of the binding positions.

22. An apparatus according to claim 20, wherein said inclining means inclines the sheet set by pushing one end of the sheet set to rotate the sheet set.

23. An apparatus according to claim 22, wherein said at least one bin tray comprises a plurality of bin trays arranged substantially vertically, and wherein said inclining means is extended substantially vertically and simultaneously rotates the sheet set on each of said plurality of bin trays.

24. An apparatus according to claim 23, further comprising sheet pushing means for pushing each sheet set after rotation of each sheet set so that a corner of each sheet set is positioned between the binding positions.

25. An image forming apparatus comprising:

image forming means;

discharging means for discharging a sheet on which an image has been formed; and a sheet binding apparatus comprising:

a plurality of bin trays arranged and spaced substantially vertically;

binding means for binding sets of sheets on each of said bin trays at a binding position;

sheet set inclining means for simultaneously inclining bound sheet sets on said bin trays to retract edges of the sheet sets from the binding positions;

wherein after operation of said sheet set inclining means, subsequent sheets are sorted on said bin trays and bound by said binding means.

26. An apparatus according to claim 25, wherein said inclining means includes a rod which penetrates said bin trays to push one end of each of the sheet sets to rotate the sheet sets.

27. An image forming apparatus comprising:

image forming means;

discharging means for discharging a sheet on which an image has been formed; and a sheet binding apparatus comprising:

at least one bin tray for accommodating sheets;

binding means for binding a set of sheets on said bin tray in at least two binding positions;

sheet set inclining means for inclining a bound set of sheets on said bin tray away from the binding positions;

wherein after operation of said sheet set inclining means, subsequent sheets are stacked on said bin tray and bound by said binding means.

28. An apparatus according to claim 27, wherein said binding means comprises a binding device for each of the binding positions.

29. An apparatus according to claim 27, wherein said inclining means inclines the bound set by pushing one end of the bound set to rotate the bound set.

30. A sheet binding apparatus comprising:

at least one bin tray for accommodating sheets;

at least one binding means for binding a set of sheets on said bin tray;

sheet set inclining means for inclining a bound sheet set on said bin tray away from a binding position;

wherein after operation of said sheet set inclining means, subsequent sheets are stacked on said bin tray and bound by said binding means, wherein said inclining means comprises a rod for pushing one end of the sheet set to rotate the sheet set.

31. An apparatus according to claim 30, further comprising sheet pushing means for pushing the sheet set after rotation ot the sheet set.

32. An apparatus according to any of claims 3, 21, or 31, wherein the sheet set is shifted in a direction of a width of the sheet set before rotation of the sheet set.

33. An apparatus according to claim 24, wherein each sheet set is shifted in a direction of a width of each sheet set before rotation of each sheet set.

* * * * *

UNITED STATES PATENT AND TRADEMARK OFFICE

CERTIFICATE OF CORRECTION

PATENT NO. : 5,918,872

DATED : July 6, 1999

INVENTOR(S) : Katsuhito KATO, et al.

It is certified that error appears in the above-identified patent and that said Letters Patent is hereby corrected as shown below:

Title page,
At [57] IN THE ABSTRACT:

Line 6, "sheets sets" should read --sheet sets--.

COLUMN 1:

Line 58, "comprises:" should read --comprising:--.
Line 62, "sheets" should --sheet--.

COLUMN 2:

Line 61, "Is" should read --is--.

COLUMN 3:

Line 3, "sorter" should read --sorter.--.
Line 31, "at" should be deleted.

UNITED STATES PATENT AND TRADEMARK OFFICE

CERTIFICATE OF CORRECTION

PATENT NO. : 5,918,872

DATED : July 6, 1999

INVENTOR(S) : Katsuhito KATO, et al.

It is certified that error appears in the above-identified patent and that said Letters Patent is hereby corrected as shown below:

COLUMN 4:

Line 46,"In" should read --in--.
Line 55, "on-sort" should read --non-sort--.
Line 64, "a" should be deleted.

COLUMN 5:

Line 12, "end" should read --end.--.
Line 32, "such" should read --in such--.

COLUMN 6:

Line 4, "he" should read --the--.
Line 45, "mediumi" should read --medium--.
Line 63, "With" should read --with--.

UNITED STATES PATENT AND TRADEMARK OFFICE

CERTIFICATE OF CORRECTION

PATENT NO. : 5,918,872

DATED : July 6, 1999

INVENTOR(S) : Katsuhito KATO, et al.

It is certified that error appears in the above-identified patent and that said Letters Patent is hereby corrected as shown below:

COLUMN 7

Line 16, "when" should read --When--; and
Line 62, "it" should read --if--.

COLUMN 8:

Line 29, "ar" should read --are--;
Line 35, "be" should be deleted; and
Line 55, "sheets sets" should read --sheet sets--.

COLUMN 9:

Line 13, "angle i2" should read --angle θ2--; and "angle i1" should read --angle θ1--.
Line 47, "said" (second occurrence) should be deleted.
Line 49, "image" should read --image forming--.
Line 57, "sheet sets" should read --sheet set--.
Line 61, "and permitting" should read --and at least one cut-away portion for permitting--.

UNITED STATES PATENT AND TRADEMARK OFFICE

CERTIFICATE OF CORRECTION

PATENT NO. : 5,918,872

DATED : July 6, 1999

INVENTOR(S) : Katsuhito KATO, et al.

It is certified that error appears in the above-identified patent and that said Letters Patent is hereby corrected as shown below:

COLUMN 10:

Line 16, "angle i2" should read --angle θ2--; and "angle i1" should read --angle θ1--.
Line 17, "moving" should read --moving means--.

COLUMN 12:

Line 27, "ot" should read --of--.
Line 28, "or 31," should read --or 30,--.

Signed and Sealed this

Fourteenth Day of November, 2000

*Attest:*

Q. TODD DICKINSON

*Attesting Officer*

*Director of Patents and Trademarks*